United States Patent [19]

Lara

[11] Patent Number: 4,750,740

[45] Date of Patent: Jun. 14, 1988

[54] TORSION SPRING EXERCISE MACHINE

[76] Inventor: Brian E. Lara, 1739 SW. 1st St., Miami, Fla. 33135

[21] Appl. No.: 803,223

[22] Filed: Dec. 2, 1985

Related U.S. Application Data

[63] Continuation-in-part of Ser. No. 706,759, Feb. 28, 1985, abandoned.

[51] Int. Cl.[4] ..... A63B 21/02

[52] U.S. Cl. ..... 272/140; 272/136

[58] Field of Search ..... 272/93, 72, 132–140, 272/143, DIG. 4

[56] References Cited

U.S. PATENT DOCUMENTS 196,435 10/1877 Clifford ..... 272/140

1,416,741 5/1922 Nicholls et al. ..... 272/136

1,983,911 12/1934 Luppert ..... 272/140

3,610,617 10/1971 Hepburn .

3,785,644 1/1974 Bradley et al. ..... 272/140

*Primary Examiner*—Richard J. Apley

*Assistant Examiner*—J. Welsh

*Attorney, Agent, or Firm*—Sanchelima, Jesus

[57] ABSTRACT

A machine for exercising in a limited space. The user stands on a base member that supports a shaft that is spring loaded with respect to a cylinder assembly that houses it. The cylinder assembly's outer surface is attached to one of the ends of each one of two cables and the other ends are attached to one or two handle bars. A locking mechanism locks the shaft in place with respect to the base member after the spring has been loaded.

4 Claims, 3 Drawing Sheets

TORSION SPRING EXERCISE MACHINE

BACKGROUND OF THE INVENTION

1. Other related applications.

The present application is a continuation-in-part of U.S. patent application Ser. No. 06/706,759 filed Feb. 28, 1985, now abandoned.

2. Field of the Invention.

The present invention relates to exercising devices, and more particularly, to such devices that include a spring biased mechanism that can be adjusted by the user to different loads.

3. Description of the prior art.

Applicant believes that the closest reference corresponds to U.S. Pat. No. 3,610,617 issued to Douglas I. Hepburn. However, it differs from the present invention because Hepburn's patent discloses brake means for frictionally adjusting the resistance to rotation. See column 1, lines 40; 41 and 42 and lines 47 through 51, where the frictional mechanisms are disclosed and it is stated that the spring loaded pulleys are only used to rewind the cable. These frictional mechanisms create particulate matters that eventually obstruct the moving parts' functions. Here, the load or resistance is totally adjusted with a spring loaded mechanism rather than a frictional one.

Other patents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an exercise machine that is compact and volumetrically efficient.

It is another object of the present invention to provide a machine that can be adjusted to different loads by adjusting the spring loaded mechanism that tends to rewind the cables pulled by the user.

It is yet another object of the present invention to provide such a machine that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF A PREFERRED EMBODIMENT

Figure 1:
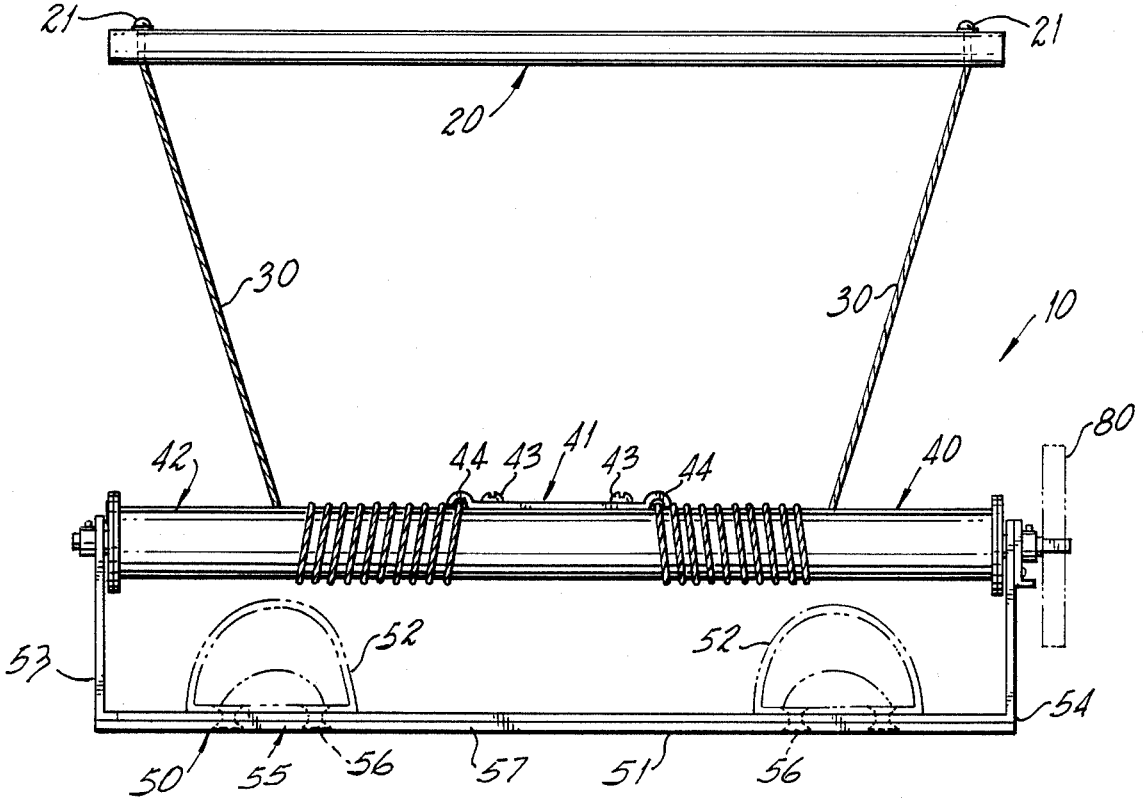
FIG. 1 represents a front view of the exercise machine.

Referring now to FIG. 1, where the present invention is generally referred to with numeral 10, it can be observed that it comprises, basically, handle bar member 20, cable members 30, rewind cylinder assembly 40 and base member 50.

Handle bar member 20, in the preferred embodiment, is a straight elongated tubular member but different shapes, or even separate handle bars for each cable 30, may be utilized. One end of each one of cables 30 is tied to bar member 20 at 21 and the other end is tied to anchorage plate 41, that is rigidly mounted on the outer surface of cylinder 42 through screws 43, at 44.

Figure 2:
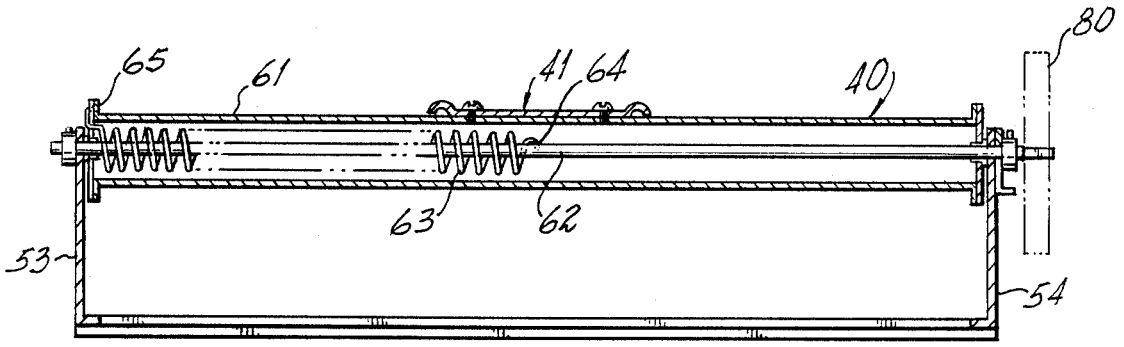
FIG. 2 shows a cross-sectional view taken along line 2—2 in FIG. 3.
Figure 6:
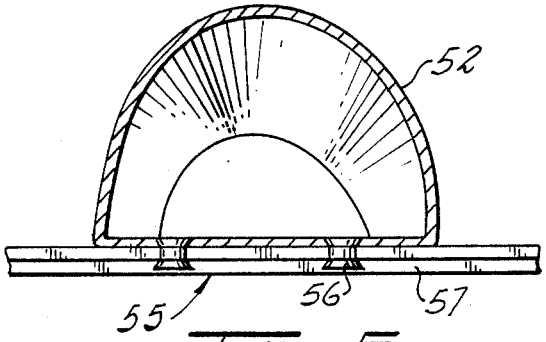
FIG. 6 is a detail representation of the guiding mechanism for the straps and one of the foot straps.
Figure 3:
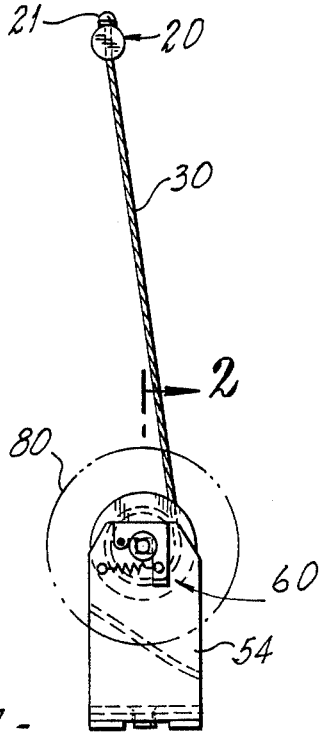
FIG. 3 illustrates a side view of a preferred embodiment of this invention.
Figure 5:
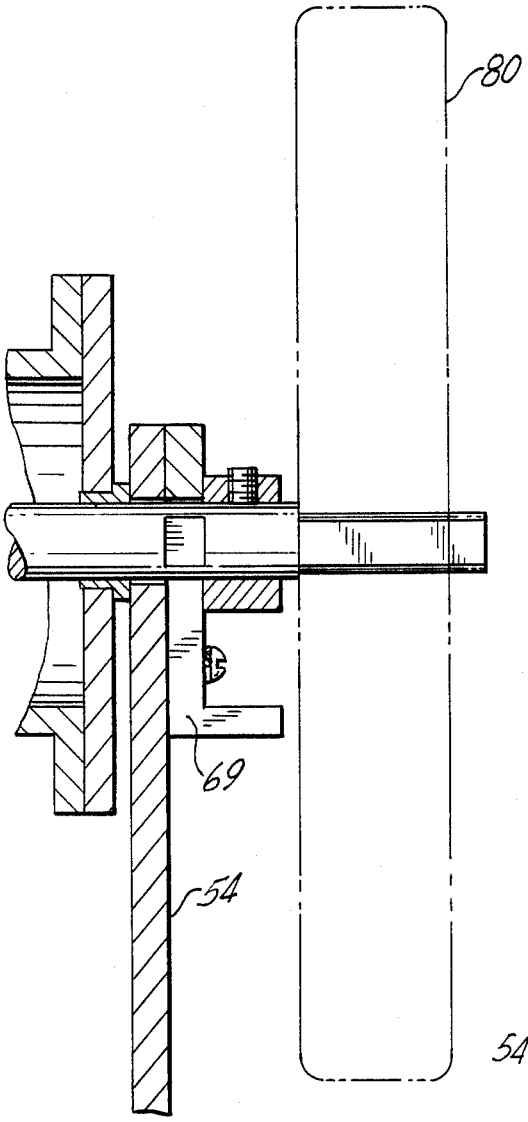
FIG. 5 represents a cross-sectional view along line 5—5 in FIG. 4 with its knob in phantom.
Figure 4:
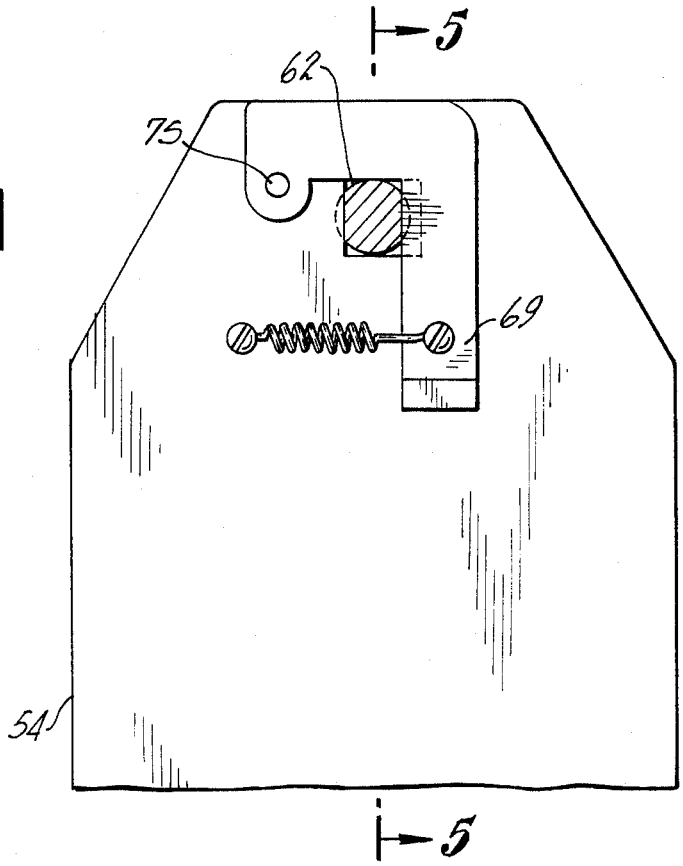
FIG. 4 is a representation of a detail in FIG. 3 showing the one-way locking mechanism.

Base member 50 has a flat bottom member 51 over which foot straps 52 are mounted to allow the user's feet to go through and apply his or her weight on member 51. Straps 52 may be separated or brought together according to the user's desire by adjustment mechanism 55, as shown in FIGS. 1; 3 and 6. Adjustment mechanism 55 allows the straps to be slidably mounted over the upper surface of member 51 by the guiding action of a headed nail 56 that travels along channel 57. Support members 53 and 54 are upwardly mounted at the ends of bottom member 51, as seen in FIGS. 1 and 2. Members 53 and 54 may be integrally built on the ends of member 51 and bent upwardly, as shown in FIGS. 1 and 2. FIG. 3 shows support member 54 with locking mechanism 60 which is better shown in FIG. 4.

As shown in FIGS. 1 and 2 cylinder assembly 40 has a cylinder member 61 over which cable 30 is wound and has a coaxially disposed shaft 62 within cylinder member 61. Shaft 62 is spring biased with respect to cylinder member 61 with helical spring member 63. Spring member 63 is rigidly attached to shaft 62 at point 64 and to cylinder member 61 at 65, as shown in FIG. 2.

Figure 7:
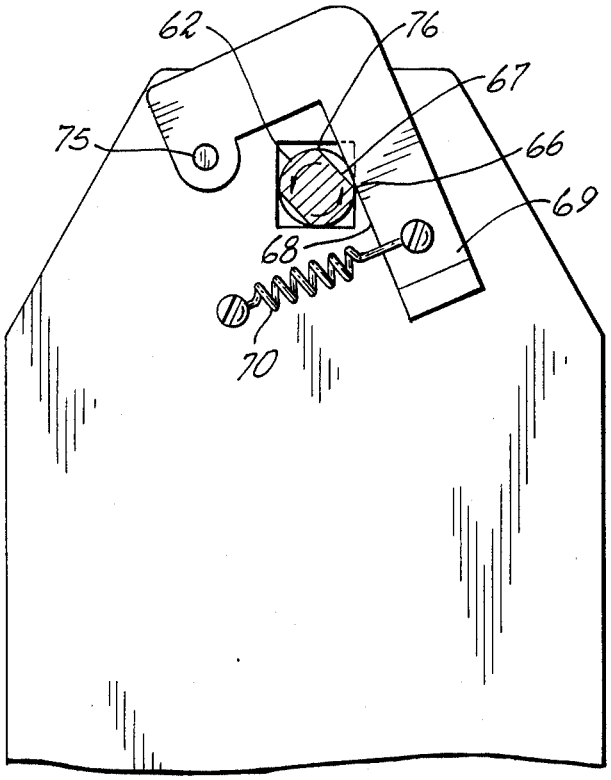
FIG. 7 shows the one-way locking mechanism with J-shape lever being slightly pushed counter-clockwise by the cam action of the edge of the flattened end portion of the shaft.
Figure 8:
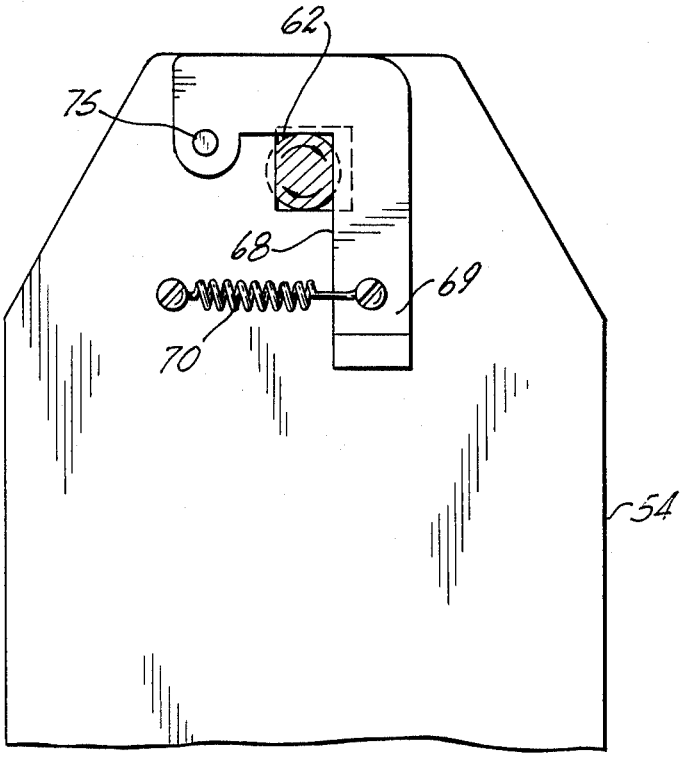
FIG. 8 shows the one-way locking mechanism with the shaft exerting a clockwise rotational force against the J-shape lever.
Figure 9:
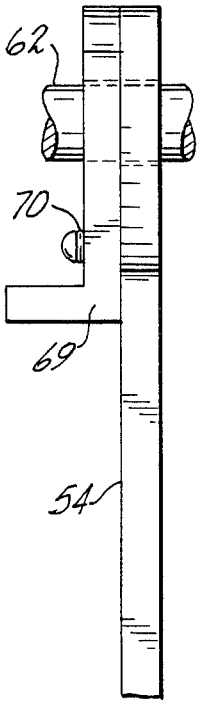
FIG. 9 is a side view of the detail shown in FIG. 8.

To load or bias spring member 63, shaft 62 is rotated with respect to cylinder 61 in one direction. In the preferred embodiment, FIG. 7 shows shaft 62 being rotated counter-clockwise and it clearly shows the camming action of side 66 of a flatened end portion 67 of shaft 62 against inner edge 68 of J-shape member 69. J-shape member 69 is attached to spring member 70 that urges J-shape member 69 to rotate clockwise around point 75. But when this counter-clockwise rotation of shaft 62, which is manually applied through removable knob 80 in the preferred embodiment, ceases then shaft 62 will be urged to rotate clockwise but this will be prevented by side 68. Member 69 will not rotate or move since the force applied by edge 76 is only going to be countered by an equal opposite tension force since the pivoting attachment at 75 prevents any lateral movement.

The user stands with both feet over member 51 using foot straps 52. Cylinder assembly 40 has been spring biased so that winding and unwinding cables 30 will require a certain pulling force from the user. Several exercise positions may be practiced by the user.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An exercise machine, comprising:

A. a base assembly having an elongated bottom member having two ends and an upwardly extending support member rigidly mounted on each of said ends;

B. a shaft having two ends rotably mounted to said support members on said ends and one of said ends protruding outwardly beyond said support member and having at least one flat portion parallel to the axis of said shaft;

C. a cylinder member coaxially housing said shaft and rotably mounted to said shaft;

D. means for spring loading said cylinder member with respect to said shaft;

E. means for locking the rotation of said shaft one way so that the tension of said means for spring loading may be adjusted in one predetermined direction and said means for locking further includes a J-shape member pivotally mounted on one of said support members and spring means connected to said J-shape member so that said J-shape member is urged against said flat portion thereby impeding the rotation of said shaft one way and allowing a camming action the other way;

F. cable means attached to the outer surface of said cylinder member on one end; and G. a handle member attached to the other end of said cable means.

2. The device set forth in claim 1 further including:

H. means for imparting a torque to said shaft.

3. The device set forth in claim 2 wherein said means for imparting a torque includes a knob.

4. The device set forth in claim 2 wherein said means for imparting a torque includes a lever.

* * * * *